US005456073A

United States Patent [19]

Thierron et al.

[11] Patent Number: 5,456,073

[45] Date of Patent: Oct. 10, 1995

[54] PROCESS AND DEVICE FOR PIECING ON AN OPEN-END SPINNING DEVICE

[75] Inventors: Wolfgang Thierron, Kosching; Ulrich Rodiger, Ingolstadt, both of Germany; Antony Ball, Charleston, S.C.

[73] Assignee: Rieter Ingolstadt Spinnereimaschinenbau AG, Ingolstadt, Germany

[21] Appl. No.: 265,098

[22] Filed: Jun. 24, 1994

[30] Foreign Application Priority Data

Jun. 28, 1993 [DE] Germany ..... 43 21 440.1

[51] Int. Cl.[6] ..... D01H 4/50

[52] U.S. Cl. ..... 57/263

[58] Field of Search ..... 57/263, 264

[56] References Cited

U.S. PATENT DOCUMENTS

| | | | |
|---|---|---|---|
| 4,384,451 | 5/1983 | Elias et al. | 57/263 |
| 4,497,166 | 2/1985 | Artzt et al. | 57/263 |
| 4,676,059 | 6/1987 | Artzt et al. | 57/263 |
| 4,998,404 | 3/1991 | Ferro et al. | 57/263 |
| 5,095,689 | 3/1992 | Ferro et al. | 57/263 |

*Primary Examiner*—Joseph J. Hail, III

*Attorney, Agent, or Firm*—Dority & Manning

[57] ABSTRACT

The instant invention relates to a process and device for piecing on an open-end spinning device. Before the beginning of the piecing process the desired run-up curve for the fiber stream which is to be fed to the fiber collection surface and the acceleration curve of the fiber feeding device corresponding to this run-up curve are defined. During piecing the fiber feeding device is switched on and is driven in accordance with the defined acceleration curve. The fiber stream produced thereby is deflected and removed on its way between the fiber feeding device and a fiber collection surface. In this process the current actual values are calculated from the acceleration curve of the fiber feeding device and the fiber stream is again fed to the fiber collection surface when a predetermined desired value has been reached, before the fiber stream which is started by switching on the fiber feeding device has reached its full strength. In coordination therewith, a yarn is fed back to the fiber collection surface and is then continuously withdrawn from the fiber collection surface while the fibers are continuously incorporated.

16 Claims, 5 Drawing Sheets

PROCESS AND DEVICE FOR PIECING ON AN OPEN-END SPINNING DEVICE

BACKGROUND OF THE INVENTION

The instant invention relates to a process and device for piecing on an open-end spinning device in which a fiber feeding device is switched on and the fiber stream produced thereby is deflected and removed on its way between the fiber feeding device and a fiber collection surface and in which a yarn is then fed back to the fiber collection surface whereupon, in synchronization with this back-feeding of the yarn, the fiber stream is again deflected and conveyed to the fiber collection surface even before the fiber stream which is started by switching on the fiber feeding device has reached its full force, and in which the yarn is again drawn off continuously while fibers are incorporated into it.

According to a known process of this type, the feeding device is first switched on to deliver fibers which are however at first prevented from reaching the fiber collection surface (DE 39 03 782 A1). In synchronization with the running-up of the fiber flow, the yarn is then fed to the fiber collection surface. When the fiber stream has reached the predetermined force below full production force, fiber removal is stopped in that the fiber stream is now fed to the fiber collection surface. The running-up of the fiber stream acting in the spinning rotor is often so rapid that sufficient time is no longer available to adapt the acceleration of yarn withdrawal to the desired extent to the running-up of the fiber stream once the fiber stream, which was first taken for removal by the fiber feeding device, has been switched over to the fiber collection surface. It has been furthermore shown that, depending on the state of the stopped fiber tuft which is exposed to the rotating opener roller, the running up of the fiber stream may be different, and this makes it difficult to determine the moment for switching over the fiber stream to begin fiber feeding to the fiber collection surface.

OBJECTS AND SUMMARY OF THE INVENTION

It is therefore a principal object of the invention to create a process, as well as a device, making it possible to adapt the feeding of undisturbed fibers to the fiber collection surface and the piecing withdrawal to each other in an improved manner. Additional objects and advantages of the invention will be set forth in part in the following description, or may be obvious from the description, or may be learned through practice of the invention.

The objects are attained through the invention in that the desired run-up curve of the fiber stream to be fed to the fiber collection surface is determined before the beginning of the piecing process, in that the acceleration curve of the fiber feeding device corresponding to this run-up curve is defined, in that the fiber feeding device is driven according to the acceleration curve after the beginning of the piecing process. The applicable actual values are at the same time calculated from the acceleration curve of the fiber feeding device and the fiber stream is again fed to the fiber collection surface as a function of the attainment of a predetermined desired value. By determining the desired run-up curve of the fiber stream to be fed to the fiber collection surface, conditions are first of all created that make it possible to determine a curve for the acceleration of yarn withdrawal. On the other hand, the acceleration curve of the fiber feeding device is determined as a function of this run-up curve. This is required because the fiber stream released by the fiber feeding device reaches the fiber collection surface only after a delay. The state of the fiber sliver end which in turn depends, in addition to the fiber material, above all on the duration of the interruption of the fiber sliver feeding before the beginning of the piecing process, is another essential factor of the run-up of the fiber stream. When the acceleration curve of the fiber feeding device has been defined, the current force of the fiber stream can be calculated from this as a function of a predetermined desired value of the speed of the fiber feeding device. It is thus possible to find the current actual values of the acceleration curve of the fiber feeding device and then, when this acceleration has reached a predetermined desired value, to feed the fiber stream which, although released by the fiber feeding device is at first removed, to the fiber collection surface. In this manner a precise coordination between the fiber stream acting upon the fiber collection surface and the yarn withdrawal is achieved. This leads to piecing joints that are optimal in strength as well as appearance.

As indicated above, the release and speed change of the fiber feeding device take effect in the fiber stream reaching the fiber collection surface only after a delay. Depending on design and operating conditions, this delay varies. To compensate for this deviation, a further development of the invention therefore provides for predetermined spinning parameters to be taken into account in determining the acceleration curve of the fiber feeding device.

Since the state of the beginning of the fiber sliver which is located in the fiber feeding device and which is presented to an opener device for separation into individual fibers varies mainly with respect to length and density, depending on the duration of the action of the opener device on the stopped fiber sliver beginning, the state of the fiber tuft is preferably ascertained at the beginning of the piecing process and is taken into account in determining the acceleration curve of the fiber feeding device. If the state of the fiber tuft is affected considerably at the beginning of the piecing process due to a long stoppage time of the spinning station, the fiber stream runs up much more slowly upon its release than after a short stoppage time. If the state of the fiber tuft is thus ascertained in the indicated manner and is taken into account in the acceleration of the fiber feeding device, a very precise adaptation of the run-up curve of the fiber stream and of the acceleration curve of the yarn withdrawal to each other is ensured.

To avoid having to determine special acceleration curves for the fiber feeding device at each piecing process, a further advantageous development of the process according to the invention can provide for different acceleration curves to be stored for the fiber feeding device and for an acceleration curve to be selected for the fiber feeding device which causes a run-up of the fiber stream equal to the desired fiber stream run-up curve to be achieved as a function of the ascertained state of the fiber tuft and of the predetermined spinning parameters.

Depending on the applicable production data, in particular in the production of fine yarns for which the fiber sliver is fed at a relatively slow speed to the opener device, it may take a long time before a fiber sliver with normal characteristics is fed to the opener device, especially if the spinning station has previously been out of service for a longer period of time while the opener equipment (opener roller) continues to run. In such case, it is an advantage for a rational design of the process according to the invention if the run-up curve for the first removed fiber stream is first brought to a predetermined value which is lower than the full strength prevailing during production, whereupon the fiber stream is maintained temporarily at a constant level while the yarn is being fed back to the fiber collection surface. The fiber stream is deflected in coordination with this back-feeding of the yarn and the yarn is again drawn off from the fiber collection surface while fibers are continuously integrated into it, whereby the fiber stream is brought to its full production level along the desired run-up curve. The run-up of the fiber stream to a predetermined value is effected by appropriate control of the acceleration of the fiber feeding device. The maintenance of constancy of the fiber stream which follows this causes the affected portion of the fiber tuft to be combed out of the advance end of the fiber sliver and is removed. The yarn end which has been suitably prepared for piecing is fed back to the fiber collection surface at the desired point in time. Furthermore, in coordination therewith, the removal of the fiber stream is ended so that the fiber stream is now fed to the fiber collection surface. The back-feeding of the yarn end to the fiber feeding surface and the switch-over of the fiber stream to convey it again to the fiber collection surface are controlled so that on the one hand the undesirable sliver end which has become unusable through damage has been removed and so that on the other hand a sufficient number of fibers are available for piecing into the back-fed yarn end. For this, it may be enough for the fiber stream to reach the fiber collection surface only when the yarn end has been fed to the fiber collection surface; but it may also be necessary for the fiber stream to be fed to the fiber collection surface through termination of the removal for the formation of a fiber ring (in a spinning rotor) or of some other fiber accumulation (e.g. fiber bundle in a friction spinning device) even before the yarn end is fed back to the fiber collection surface. Then, after the actual piecing, if the yarn is then drawn off from the fiber collection surface at an increasing draw-off speed while newly fed fibers are continuously incorporated into it, the fiber stream can also be brought to its full production force through suitable acceleration of the fiber feeding device in synchronization with the yarn withdrawal.

It is in principal not significant whether the run-up of the fiber stream is adapted to the acceleration of yarn withdrawal or, vice versa, whether the acceleration of the yarn withdrawal is adapted to the run-up of the fiber stream. For the sake of simplification of control it has been however shown to be advantageous if the run-up of the yarn withdrawal speed is carried out as a function of the run-up of the fiber stream.

In an alternative and practical embodiment of the process according to the invention provisions may be made for the run-up of the yarn withdrawal speed to be monitored and for the acceleration curve of the fiber feeding device to be corrected as a function of the run-up of the yarn withdrawal speed when the run-up of the fiber stream is not synchronized with the run-up of the yarn withdrawal speed.

To carry out the process, the invention provides for the fiber feeding device to be associated with a drive arrangement whose acceleration can be controlled by a control device and by means of which the deflection equipment and the drive arrangement of the draw-off device of the yarn are controllably connected. Thus the drive arrangement of the fiber feeding device, the drive arrangement of the yarn withdrawal equipment as well as the deflection device which deflects the fibers and conveys them to a removal device, are connected to the control device. The control device is thus able on the one hand to determine the acceleration curve for the fiber feeding device and on the other hand to control the fiber stream switch-over device in such a manner that the fibers are again fed to the fiber collection surface when the fiber feeding device has reached a predetermined speed, while at the same time the yarn withdrawal can be controlled as a function of the acceleration of the fiber feeding device and thereby of the run-up of the fiber stream.

In an advantageous embodiment of the invention, the control device is connected for control to a scanning device which detects the fiber stream.

This scanning device may be of varying design and may detect the fiber stream directly or only indirectly. In order to detect the intensity of the fiber stream directly, the scanning device is suitably installed in the form of a contact-less fiber stream measuring device installed along the path of the fiber stream, between fiber feeding device and fiber collection surface, located preferably between the fiber stream deflection point and the fiber collection surface.

Since the combed-out state of the fiber tuft at the beginning of the piecing process is instrumental in determining the run-up of the fiber stream, it is possible to use the combed-out state of the fiber tuft (advance end of the fiber sliver) and the time since release of the fiber feeding device as the basis to indirectly determine the fiber sliver for this purpose. In another advantageous embodiment of the device according to the invention, it is possible for the scanning device to be made in the form of a device to determine the combed-out state of the fiber tuft at the point in time when the piecing process is initiated.

As mentioned earlier, the acceleration curve of the fiber feeding device is defined by the control device. For this purpose, the control device may be programmed in order to achieve the desired acceleration behavior. To be able to intervene also manually in the acceleration behavior of the fiber feeding device, it is advantageous for the control device to be associated with an adjusting device to define the desired run-up curve of the fiber stream. It is advantageous in that case to make the adjustment device in the form of an input device for the spinning parameters. The control device is then designed so that it determines autonomously the deviations between run-up of the fiber stream and acceleration curve of the fiber feeding device on basis of the entered spinning parameters such as sliver feeding speed, sliver thickness, rotational speed of the opener roller, etc. These spinning parameters are known to the spinning machine operators and can easily be entered. However, they can easily be entered automatically if required, by using a suitable control connection between the relevant devices of the machine and the control device.

It has been shown that in principle the same accelerations are always required for the fiber feeding device. For this reason it has proven to be sufficient and a useful embodiment of the invention if the control device is provided with a program memory with several programs for the acceleration of the fiber feeding device, a program being then selected as a function of the state of the fiber tuft and/or of the given spinning parameters in order to obtain the desired run-up curve of the fiber stream.

Since the yarn withdrawal can be controlled only within certain limits, e.g. when the piecing draw-off is effected by means of the bobbin which takes up the yarn, an advantageous embodiment of the device according to the instant invention provides for a control device which monitors the speed of the draw-off device for the synchronization of the speeds of fiber stream run-up and yarn withdrawal and is connected for control via the control device to the drive arrangement of the fiber feeding device.

The instant invention creates the right conditions for high-quality, unobtrusive piecing joints in a simple and reliable manner. At the same time, individual adaptation to many different conditions is possible by means of manual or electronic adjustment.

Examples of embodiments of the process according to the invention as well as of the device according to the invention are described in further detail below through the drawings.

BRIEF DESCRIPTION OF THE DRAWINGS

FIG. 3 schematically shows the effect of the opener device influencing the run-up of the fiber stream for various lengths of time when a non-controlled fiber feeding device is switched on;

DETAILED DESCRIPTION OF THE PREFERRED EMBODIMENTS

Figure 1:
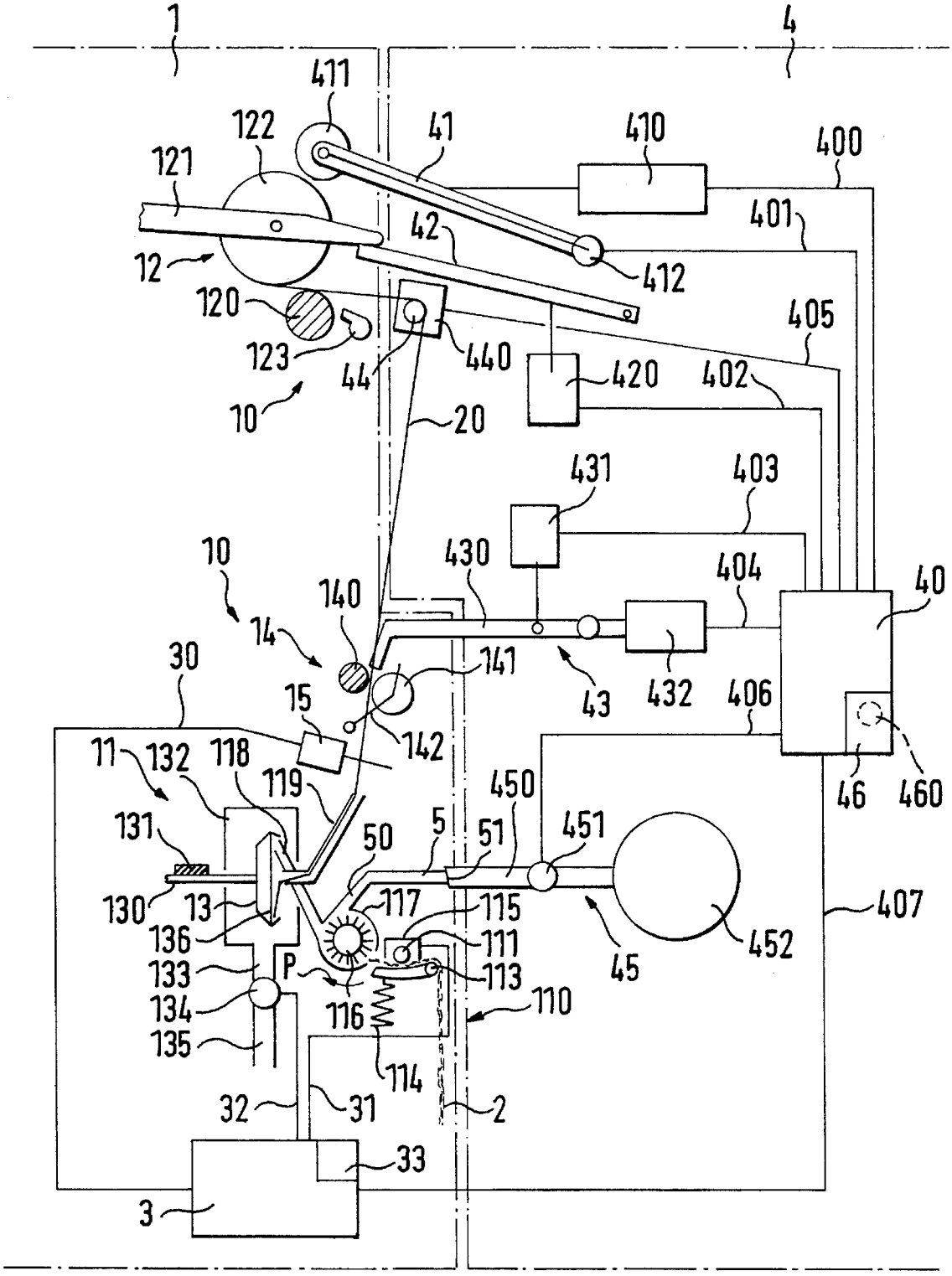
FIG. 1 shows a spinning station designed according to the invention, in a schematic side view.

Reference will now be made in detail to the presently preferred embodiments of the invention, one or more examples of which are illustrated in the accompanying drawings. Each example is provided by way of explanation of the invention, and not as a limitation of the invention. In fact, it will be apparent to those skilled in the art that various modifications and variations of the invention can be made without departing from the scope or spirit of the invention. Additionally, the numbering of components in the drawings is consistent throughout the application, with the same components having the same number in each of the drawings.

At first the device to carry out the process shall be described through FIG. 1 to the extent necessary in order to explain the problem to be solved and the new process.

FIG. 1 shows in its left half and in a schematic drawing a spinning station 10 of an open-end spinning machine 1. This spinning station 10 is provided with an open-end spinning device 1 and with a winding device 12.

Each open-end spinning device 11 is provided with a fiber feeding device 110 for the feeding of a fiber sliver 2 to an opener device 116. The fiber feeding device 110 consists in the shown embodiment of a delivery roller 111 and of a feeding trough 112 interacting elastically with delivery roller 111. The feeding trough 112 is mounted pivotably on an axle 113 and is pressed elastically against the delivery roller 111 by means of a spring 114. The delivery roller 111 is driven via a drive 115.

The opener device 116 in the embodiment shown in FIG. 1 is made substantially in the form of an opener roller contained in a housing 117. A fiber feeding channel 118 extends from it to a spinning element 13, which is a spinning rotor in the embodiment shown. The control device 3 is driven or braked in the usual manner. In the shown embodiment, the spinning element 13 in the form of a spinning rotor is provided with a shaft 130 against which a tangential belt 131 is bearing, or from which it can be lifted.

The shown spinning element 13 is located in a housing 132 provided with a suction opening 133 which is connected via a controllable valve 134 and a suction circuit 135 to a source of negative pressure which is not shown.

A yarn draw-off pipe 119 is provided to guide the yarn 20 to be drawn off from the spinning element 13. The withdrawal is effected by means of a pair of draw-off rollers 14 consisting of a driven draw-off roller 140 and of a draw-off roller 141 bearing elastically against same and driven by it. For this purpose, the draw-off roller 141 is mounted on a swivel arm 142.

On its way between the spinning device 11 and the pair of draw-off rollers 14, the yarn 20 is monitored by a yarn monitor 15.

The yarn 20 is wound up in the winding device 12 which is equipped with a driven winding roller 120 for that purpose. The winding device 12 is furthermore equipped with a pair of swivelling bobbin arms 121 which hold a bobbin 122 rotatably between them. The bobbin 122 lies on the winding roller 120 during undisturbed operation and is therefore driven by the latter. The yarn 20 to be wound up on the bobbin 122 is inserted into a traversing yarn guide 123 which is moved back and forth along the bobbin 122 and thus ensures even distribution of the yarn 20 on the bobbin 122.

The yarn monitor 15 and the drive 115, as well as the valve 134, are connected for control via circuit 30, 31, and 32 to a computer or control device 3. This control device 3 contains a time measuring element 33 which measures the time from stoppage of the fiber feeding device 110 until the beginning of the piecing process. Further details shall be described subsequently.

A service unit 4 which is also equipped with a control device 40 connected for control via a circuit 407 to the computer or to the control device 3 of the open-end spinning machine 1 for the control of the piecing process is able to travel along the open-end spinning machine which is provided with a plurality of identical spinning stations 10. The control device 40 is furthermore connected via a circuit 400 to the swivel drive 410 of a swivel arm 41 which supports an auxiliary drive roller 411 on its free end. The auxiliary drive roller 411 is driven by a drive motor 412 which is also connected via a circuit 401 to the control device 40 for control.

The bobbin arms 121 of the winding device 12 can be assigned swivel arms 42 pivotably mounted on the service unit 4 and the swivel drive 420 of which is connected for control via circuit 402 to the control device 40.

Swivel arms 42, pivotably mounted on the service unit 4 can be presented to the bobbin arms 121 of the winding device 12, their swivel drive 420 being connected for control via a circuit 402 to the control device 40.

A lift-off device 43 can be presented to the draw-off roller 141 of the pair of draw-off rollers 14. This lift-off device is equipped with a swivel arm 430 able to cooperate with the swivel arm 142 of the draw-off roller 141. For this purpose the swivel arm 430 is connected to a swivel drive 431 and to a lifting drive 432 which are in turn connected via circuits 403 or 404 to the control device 40 for control.

The service unit 4 is furthermore equipped with a yarn cast-off device 44 with a drive 440 controlled by the control device 40 via a circuit 405.

The outlet 50 of a suction channel 5 whose end away from the opener device 116 can be closed by means of a butterfly valve 51, lets out into the housing 117 of the opener device 116 in the open-end spinning machine 1 after the outlet of the fiber feeding channel 118 (as seen in the direction of fiber movement (arrow P)). A suction channel 450 of a suction device 45 of the service unit 4 can be presented to the suction channel 5 of the open-end spinning machine 1. This suction channel 450 is connected via a valve 451 to a negative-pressure source 452. The valve 451 is in turn connected for control via a circuit 406 to a control device 40 containing a time control element 46.

Since the fiber stream is fed by the fiber feeding device 110 to the fiber collection surface 136 or to the suction channel 450 through control of the valves 134 and 451, as shall be explained in further detail below, these valves 134 and 451 together constitute a switching-over device, while the suction channel 5 and the suction channel 450, together with the valve 451, constitute a deflection device which deflects the fiber stream from its path between the opener device 116 and the spinning element 13 or its fiber collection surface 136.

During normal spinning operation, the fiber sliver 2 is fed by means of the fiber feeding device 110 to the opener device 116 which opens the fiber sliver 2 into fibers being fed to the fiber collection surface 136 of the spinning element 13 to be deposited there. The end of the yarn 20 in the process of being drawn off is connected to this fiber accumulation which constitutes a fiber ring in the spinning rotor shown as an example and incorporates the fibers into its end as a result of the twist it is imparted by the rotation of the spinning rotor while the yarn 20 is being withdrawn by the draw-off device 14 from the spinning device 11. The bobbin 122 bears in a known manner on the winding roller 120 during the spinning process and thus winds up the yarn 20 while the traversing yarn guide 123 distributes the yarn in a traversing manner on the bobbin 122.

Before describing the new piecing process, the piecing process used until now shall be discussed.

After the start of the piecing program, the fiber feeding device 110 starts running again at a predetermined point in time so that the fiber flow is started again. Since the forward fiber sliver end, which constitutes a fiber tuft 21 and is presented to the opener device 116 which continues to run, was combed out to a greater or lesser extent due to the preceding stoppage time, so that the fiber tuft 21 is now considerably thinner than during normal production, the fiber tuft 21 must first be advanced for a certain distance until a fiber tuft 21 similar to the one existing during production may again be presented to the opener device 116. In addition, it is necessary that the fibers 22 presented to the opener device 116 fill the clothing of the opener device 116 and be conveyed by the latter. A certain time span is required for this, and for this reason the run-up curve of the fiber flow will be more or less steep, depending on the stoppage time.

When the fiber flow has reached full strength, it is switched over in the known process at any point in time after reaching full fiber flow, so that 100% of the fibers again reach the fiber collection surface 136 of the spinning element 13.

In synchronization with the release of the fiber flow, a yarn end is fed back into the spinning rotor, or to another spinning element 13, so that it may combine with the fibers arriving at that location. In synchronization with the yarn back-feeding and possibly coincidental with same or at a slightly earlier or later point in time, yarn withdrawal begins and accelerates to its operating speed (100%). A certain amount of time is necessary for this. The greater the mass to be accelerated in the piecing draw-off, the longer this time span will be. Thus the piecing withdrawal lasts longer if it is effected by means of the bobbin 122 than if it is effected by means of the pair of draw-off rollers 14. In that case a surplus of yarn is however produced between the pair of draw-off rollers 14 and the bobbin 122, must be put in intermediate storage and must be used up again when the bobbin 122 has reached its full speed.

As indicated earlier, the run-up curve of the fiber flow will vary in length, depending on the stoppage time of the fiber tuft 21 while the opener device 116 continues to run. With the help of FIGS. 2*a* to 2*c*, the effects of a stoppage time of varying length of the fiber feeding device 110 upon the forward end of the fiber sliver 2, i.e. upon the fiber tuft 21, while the opener device 116 continues to run shall be described.

Figure 2:
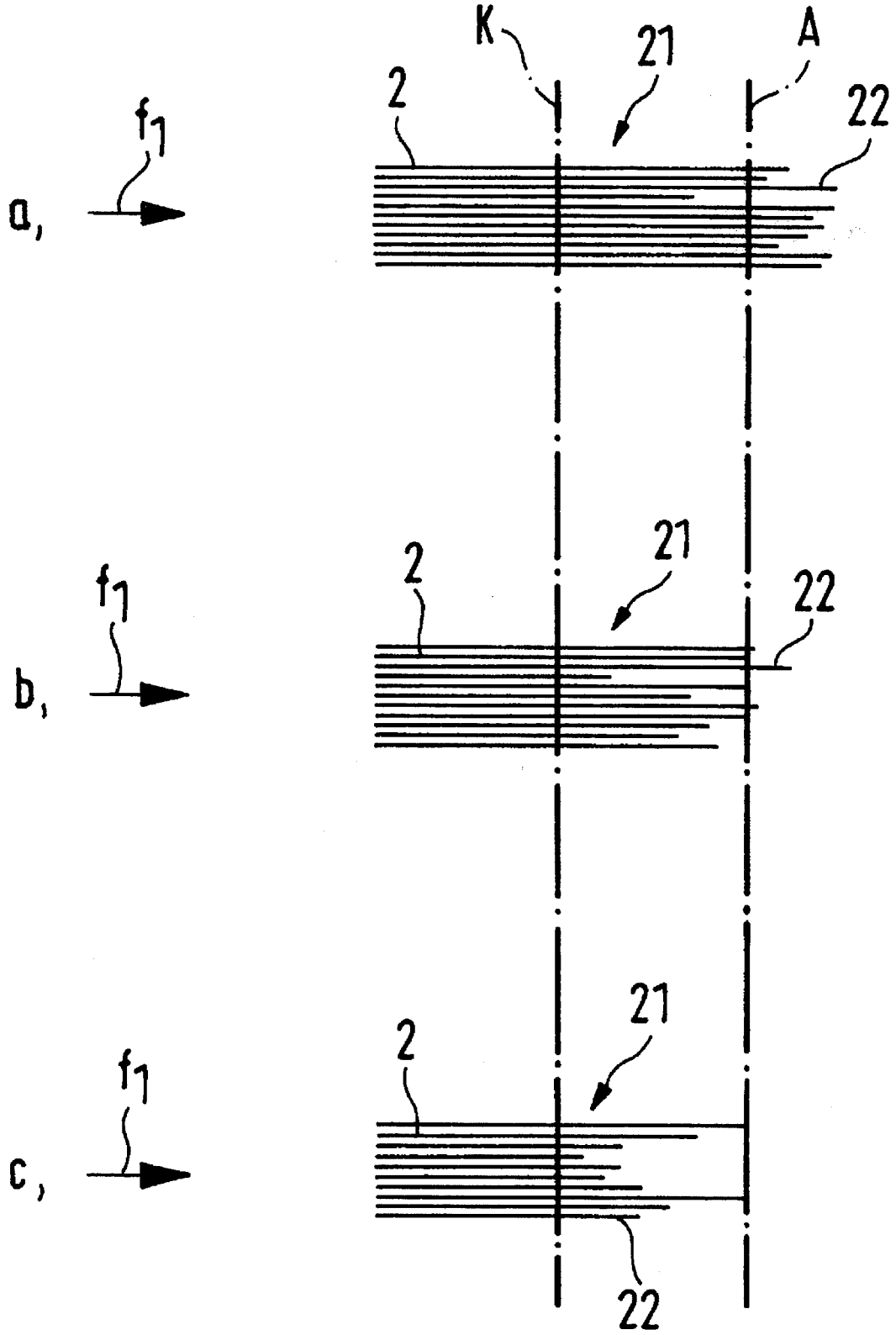
FIG. 2*a*–2*c* show a schematic representations of a fiber tuft which has been exposed to the effects of an opener device for different lengths of times after the stoppage of the fiber sliver.

In FIGS. 2*a* to 2*c*, the nip K is shown in which the fiber sliver 2 is clampingly held while the fiber feeding device 110 is stopped. The nip K is formed by the line in which the feeding trough 112 presses the fiber sliver 2 against the delivery roller 111.

FIGS. 2*a* to 2*c* furthermore show line A which represents the limit of the operating range of the opener device 116.

During the normal spinning process, when the fiber feeding device 110 and the opener device 116 (e.g. opener roller) are running, the opener device 116 (in FIGS. 2*a* to 2*c*, from the right) influences the fiber tuft 21 up to line A and combs fibers 22 out of it, these fibers being then fed through the fiber feeding channel 118 to the spinning element 13. As shown in FIG. 2*a*, the fibers 22 extend here in part far beyond line A and into the operating range of the opener device 116, while other fibers 22 only reach as far as the area between the nip K and the line A.

The aspect of the fiber sliver 21 is similar when the fiber feeding device 110 is stopped for a brief period of time.

In the case of longer stoppages of the fiber feeding device 110 and continuing operation of the opener device 116, the latter continues to comb fibers 22 out of the fiber tuft 21. In that case the fiber tuft 21 contains only few fibers reaching beyond line A (FIG. 2*b*). The longer the stoppage of the fiber feeding device 110 (always with continued operation of the opener device 116), the shorter the fiber tuft 21 becomes, until no fibers 22 reach into the operating range of the opener device 116 in the case of a long stoppage, i.e. until only the longest fibers 22 extend from the nip K to line A (FIG. 2*c*).

As indicated above, a surplus of yarn is produced and must be put into an intermediate storage when the withdrawal is effected by means of the pair of draw-off rollers 140, 142. In order to avoid the need for such a storage, another process is provided and is explained below through the diagram shown in FIG. 3.

The speed of the fiber feeding device 110 is represented upward on the vertical axis of the diagram by means of a solid line. Furthermore three examples of the fiber flow $F_1$, $F_2$ and $F_3$ taking place in the spinning element 13 are shown toward the top. The fiber flow $F_{1a}$, $F_{2a}$ and $F_{3a}$ which is fed to the suction channel 5 and thus does not enter the spinning element 13 is shown downward by means of a solid line.

The time t is entered on the horizontal time axis.

At the point in time, $t_1$ the fiber feeding device 110 begins to run, so that the fiber flow is started again. Since the fiber tuft 21 must first be advanced by a given distance until a fiber tuft 21 such as exists during production can again be presented to the opener device 116, the fiber flow is resumed only with a delay.

The process shall first be described in connection with a fiber tuft 21 which has been exposed to the opener device 116 for only a brief time in its stopped state.

Figure 3:
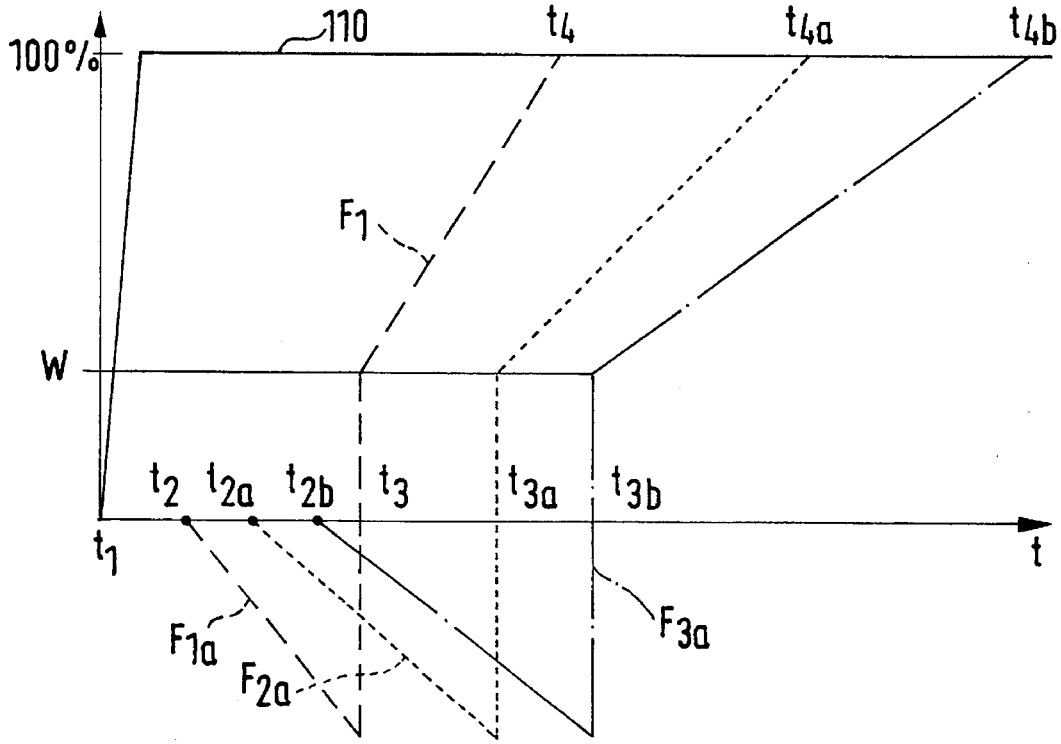

As in the previously described process, the fiber flow $F_{1a}$ goes first into the suction channel 5 as of point in time $t_2$ and is taken away through suction channel 45, so that no fibers reach the fiber collection surface 136 of the spinning element 13. By contrast with the process described above, another deflection of the fiber flow $F_{1a}$ takes place, and it is fed (feed $F_1$) to the fiber collection surface 136 of the spinning element 13 already a long time before the point in time $t_4$ is reached, at which time full fiber flow is again attained, so that all the fibers reach the spinning element 13 as of point in time $t_3$ which is before point in time $t_4$. The deflection of the fiber flow and its conveying to the spinning element 13 thus occur during the run-up of the fiber flow, i.e. before the fiber stream or fiber flow started by switching on the fiber feeding device 110 has reached its full production strength. The end of the yarn 20 which is prepared in the usual manner is fed back to the fiber collection surface 136 of the spinning element 13 which is also driven in the usual manner at a point in time synchronized with the switching over of the fiber flow. Yarn withdrawal then starts. Since the run-up curve of the fiber flow is considerably flatter with the new process as shown in FIG. 3 than with the process used in the past, the run-up of yarn withdrawal speed can as a rule be well controlled and adapted to the run-up curve of the fiber flow, so that the run-up of the yarn withdrawal deviates only minimally from the run-up curve of the fiber flow. This means that the piecing joint deviates only minimally from the normal yarn thickness and thus from the desired thickness.

As will be explained in further detail through FIG. 3, different run-up attitudes of fiber feed result from the different states of the fiber tuft 21 (see FIGS. 2*a* to 2*c*).

When the fiber feeding device 110 is started up again at the point in time $t_1$, following a stoppage period, the fiber sliver 2 is conveyed in the direction of arrow f (FIGS. 2*a* to 2*c*) and fed to the opener device 116. If the stoppage time of the fiber feeding device 110 is very short (see FIG. 2*a*), the fiber tuft 21 has practically the same form as during the spinning process itself. Fiber feed, i.e. the fiber stream arriving on the fiber collection surface of the open-end spinning element 13, again reaches its full value (see point in time $t_4$) with a minimal delay caused by the time required in order to produce once more a fiber stream between fiber feeding device 110 and open-end spinning element 13.

If the stoppage time was longer (FIG. 2*b*), a weakened fiber tuft is at first present in the operating range of the opener device 116. Following the release of the fiber feeding device 110, only a somewhat meager fiber stream reaches at first the fiber collection surface 136, and also begins with a somewhat greater time delay than the fiber flow according to FIG. 2*a* (see point in time $t_{2a}$). Even if more and more fibers 22 come within the operating range of the opener device 116 during the subsequent transportation of the fiber sliver 2 in the direction of arrow $f_1$, fiber feeding does not increase suddenly to its full value (100%) but requires a certain amount of time to do so. The run-up time (between the points in time $t_{2a}$ and $T_{4a}$) for a fiber tuft 21 according to FIG. 2*b* is therefore longer than for a fiber tuft 21 according to FIG. 2*a*.

The situation becomes even more extreme with a fiber tuft 21 which has been subjected for a very long time to the effect of the opener device 116 while the fiber feeding device 110 was stopped. In the case of very long stoppage times, the fiber tuft 21 must first be moved in the direction of arrow $f_1$ past line A and within operating range or into the area of influence of the opener device 116. Since the fiber tuft 21 according to FIG. 2*c* was combed out to a much greater extent than the fiber tuft 21 according to FIG. 2*b*, it takes longer before the fiber flow begins. The run-up time (between the points in time $t_{2b}$ and $T_{4b}$) is also considerably longer.

As FIG. 3 shows, much fiber material arrives relatively quickly within range of the opener device 116, so that the interval between points in time $t_2$ and $t_4$ may become very short. If the yarn is drawn off by means of bobbin 122 following the piecing operation, providing many advantages, it is often not possible, in particular with large bobbins 122, to withdraw the bobbin 122 and thereby the spun yarn 20 so rapidly that the yarn withdrawal is synchronized with the increase of fiber flow. Deviations in yarn thickness, as a rule thick spots, are then the result.

In order to avoid this disadvantage, a certain run-up curve is defined for the fiber stream in such a manner that the yarn withdrawal can follow the run-up process, so that the yarn is essentially equal to the desired yarn number even during the time when normal production conditions have not yet been achieved.

The manner in which the yarn withdrawal is to be controlled is determined first. The acceleration of the yarn withdrawal is here determined so that the increase in tension in the newly pieced yarn is not too great. Overly rapid acceleration involves the danger of a yarn breakage, in particular in the area of the piecing joint, since this area has as a rule less strength than the yarn outside the piecing joint area. A soft withdrawal start can be achieved in that the piecing withdrawal is effected by means of bobbin 122, since the latter can be brought to its production speed with considerably less acceleration than with the draw-off device 14 because of its relatively great mass.

Once the desired run-up curve for yarn withdrawal has been determined, the run-up curve for the fiber stream is determined. Here the run-up curve for the fiber stream is determined as it reaches the fiber collection surface 136. For, as shall be explained below, the fiber stream reaches the point where the fiber tuft 21 is combed out by the opener device 116 at a different time than the point where the fiber stream reaches the fiber collection surface 136. For the incorporation into the yarn 20 however, only the fiber stream reaching the fiber collection surface 136 is of interest.

The above-mentioned determinations of the curves are made before piecing and are part of the piecing program. The acceleration curve of the fiber feeding device corresponding to this run-up curve is also determined before piecing.

As stated earlier, the fiber flow and the run-up curve of the fiber feeding device 110 are not in a fixed relationship to each other. Aside from such factors as configuration and speed of the opener device, fiber material, etc., the delay of the switching on of the fiber feeding device 110 and entry into effect of the fiber stream in the spinning element 13 as well as the increase in fiber flow in the spinning element 13 changes above all as a function of the stoppage time of the fiber tuft 21 while the opener device 116 continues to run.

In order to achieve a synchronous run-up of fiber stream and yarn withdrawal (always in percentages of full production values), even when the stoppage time is very short, the run-up curve of the fiber stream is flattened in a predetermined manner by switching on the fiber feeding device 110, the acceleration of which is controlled by the control device 3, so that yarn withdrawal is able to follow this yarn stream run-up curve (run-up curve of the fiber flow), even in the case that the bobbin 122 has a great diameter and therefore a great mass to be accelerated.

In addition to the acceleration evolution of the fiber feeding device 110, the point in time is determined at which the fibers 22 which are at first prevented from reaching the fiber collection surface 136 are to be again fed to this fiber collection surface 136 so that later, during the piecing operation, the fiber feeding device 110 may be switched over during piecing as a function of the speed it attains. The necessary monitoring takes place in this case in the control device 3, for example which transmits the required signals (e.g. voltage or frequency), to the drive 115 depending on the desired speed of the fiber feeding device 110 or by scanning the rotational speed of the delivery roller 111 or of its drive shaft. The current actual values of the acceleration of the fiber feeding device 110 are here detected or monitored continuously. If the pre-programmed actual value is then reached, the previously removed fiber stream is deflected so that it is now again fed to the fiber collection surface 136.

Figure 4:
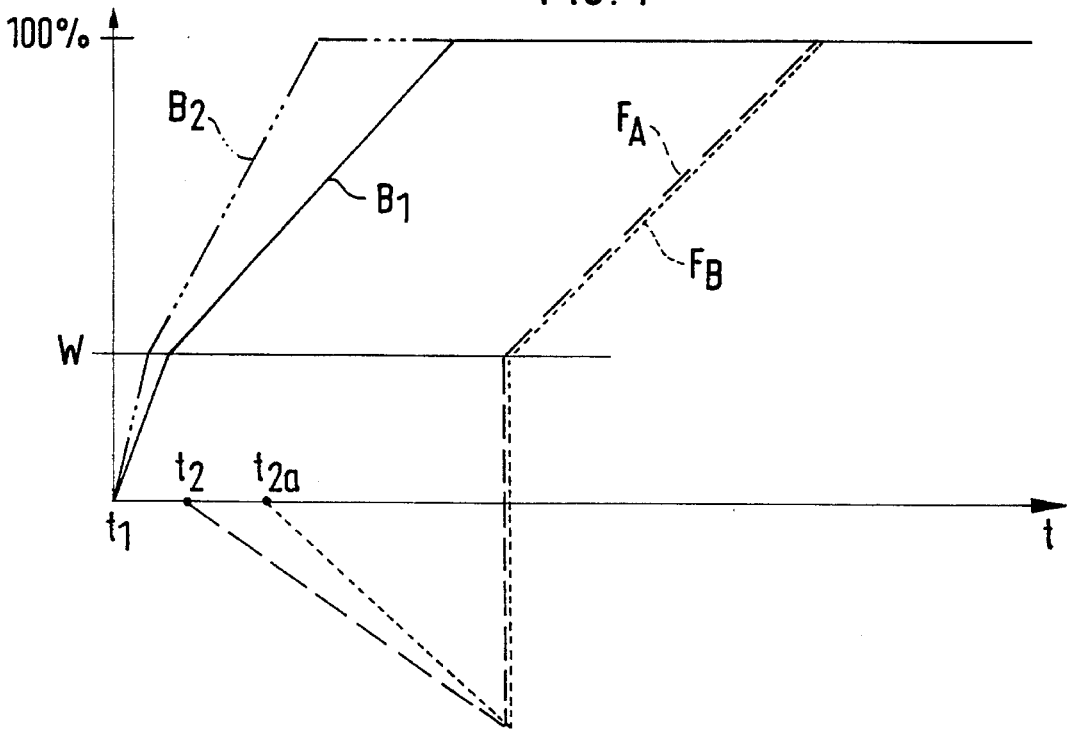
FIG. 4 schematically shows different acceleration curves of the fiber feeding device for the obtention of a predetermined run-up curve of the fiber stream with fiber tufts having been affected to different degrees.

According to FIG. 4, the run-up curve of the fiber stream F is determined in such a manner that starting at the moment when it reaches the same percentile value W as the not-shown yarn withdrawal, it proceeds in synchronization with the yarn withdrawal until the production values have been reached. Depending on the stoppage time of the fiber sliver 21 which is subjected to the influence of the continuously running opener device 116, it is necessary, in order to obtain this run-up curve of the fiber stream determined in the manner described earlier, for the fiber feeding device 110 to be brought from stoppage to its production speed in different ways.

As examples of embodiments, FIG. 4 shows two curves $F_A$ and $F_B$ for the fiber stream which take effect in the spinning element 13 for reason of different stoppage times at the points in time $t_2$ or $t_{2a}$ (see FIG. 3). In order to cause the two curves $F_A$ and $F_B$ to coincide, a greater acceleration of the fiber feeding device 110 is selected as the run-up curve of the fiber flow is flatter due to the stoppage time of the fiber tuft 21 (while the opener device 116 continues to run). Thus the acceleration curve $B_1$, for example, of the fiber feeding device 110 is required to control the fiber flow $F_2$ (FIG. 3) so that it may follow the curve $F_1$. On the other hand the acceleration curve $B_2$ of the fiber feeding device 110 corresponds to the curve $F_B$. As show in FIG. 4, the curves $F_A$ and $F_B$ coincide at least at the moment when they have reached the same percentile value W as the not-shown yarn withdrawal.

If the yarn withdrawal is sufficiently slow it may follow the correspondingly flat curves $F_1$ and $F_B$ for all bobbin sizes.

The new process having been explained in principle above, shall now be explained in greater detail below as carried out in the device whose structure has already been described.

When a yarn breakage occurs, it is signalled by the yarn monitor 15 to the control device 3 which switches on the time measuring element 33. At the same time the drive 115 of the fiber feeding device 110 which stops the delivery roller 111 and thus stops the feeding of more fiber sliver 2 to the opener device 116 is actuated. In a manner not shown here, the bobbin 122 is furthermore lifted off the winding roller 120 so that the end of yarn 20 cannot be wound into the bobbin surface by the continuously running bobbin 122. Furthermore, the spinning element 13 is stopped in the usual manner. The opener device 116 however continues to run without interruption.

The service unit 4 arrives after a certain time at this spinning station 10 at which the yarn 20 has broken. For this, the service unit 4 can be called to this spinning station by a not-shown, known call-up system. The service unit 4 can, however, also continuously patrol along a defined number of spinning stations and reach the spinning station 10 affected by a yarn breakage also in this manner. When the service unit 4 has arrived at the concerned spinning station 10, its control device 40 interrogates the control device 3 via circuit 407 and thus learns whether service is required or not at the spinning station 10 in question. The control device 3 is designed so that it only transmits that information at one time to the service unit 4 which concerns the spinning station 10 at which the service unit 4 is located at the moment.

When the service unit 4 is located at a spinning station 10 which is to be serviced, the service unit 4 stops. The bobbin arms 121 are supported in the manner already described via the swivel arms by the bobbin lifting device of the machine. Furthermore, the auxiliary drive roller 411 is presented to the bobbin 122. The suction channel 5 on the machine is further presented the suction channel 450 of the service unit 4. Also, the draw-off roller 141 is lifted off the driven draw-off roller 140 by means of the lift-off device 43 and the yarn 20 is drawn off in the usual manner from the bobbin 122 which is lifted off the winding roller 120 and is fed back into the yarn draw-off pipe 119. The yarn is laid over the yarn cast-off device 44 in this process and is held there.

During this time, the spinning element 13 is cleaned in the known manner. The fibers and dirt particles detached from the spinning element 13 are removed through the suction channel 5 by means of the negative spinning pressure which is present now as before in the housing 132.

After the cleaning of the spinning element 13, the valve 134 for negative spinning pressure is closed through the interaction of the control devices 3 and 30 and the valve 451 of suction channel 450 is opened. Furthermore the spinning element 13 which had been stopped until then is released again and runs up to its operating speed or only to a pre-set piecing speed. The piecing program can be designed in such a manner in this case that piecing is carried out either at a stationary speed of the spinning element 13 or during its run-up curve. If piecing is carried out during a reduced but stationary rotor speed, the spinning rotor is preferably brought to its production speed in such a manner that its run-up curve is synchronized with those of the fiber flow and of the yarn withdrawal or extensively adapted to the latter.

At the beginning of the piecing program, i.e. at the beginning of the work performed by the service unit 4 at the affected spinning station 10, the control device 3 transmits an impulse to the time measuring element 33 which has thus recorded the stoppage time of the fiber feeding device 110 from the occurrence of the fiber breakage until the beginning of the piecing device (with the opener device 116 continuing to run uninterruptedly). The fiber feeding device 110 is then switched on again by actuating the drive arrangement 115. The fiber sliver 2 is thereby fed to the opener device 116 once more, but is sucked away from it and out of housing 117 by the active negative pressure source 452. At the point in time $t_3$ or $t_{3a}$ or $t_{3b}$ (FIG. 3) which is determined by the control device 3 as a function of the stoppage time recorded by the time measuring element 33, the valves 134 and 451 are now actuated so that no negative pressure is active any longer in the suction channel 5 and so that instead the negative spinning pressure is again acting via suction pipe 135 in housing 132. The fibers entering the housing 117 of the opener device 116 are thus sucked through fiber feeding channel 118 to the spinning element 13 where they are deposited in a known manner on the fiber collection surface 136.

The point in time $t_3$ which is set by the control device 3 and at which the negative pressure in the suction pipe 135 is switched on is selected so that the fiber flow has not yet reached its full strength. The above-mentioned control means (control devices 3 and 40, valves 134, 451) influence the device (suction opening 133, suction channel 5) for the deflection of the fiber stream or fiber flow so that the fiber flow reaches the fiber collection surface 136 as a function of the yarn back-feeding. As mentioned earlier, this switch-over takes place in such a manner that the fiber flow or fiber stream has not yet reached its full operating strength at that point in time after the switching on of the fiber feeding device 110.

Information (depending on the spinning parameters such as fiber material, staple fiber length, configuration of the fiber feeding device 110 etc.) is stored in the control device 3 concerning the manner in which the fiber feeding device 110 is to be controlled during a given stoppage time so that the desired curve of fiber flow may be obtained. The delivery roller 111 is accelerated through drive 115 in accordance with the desired increase in fiber flow on the fiber collection surface 136 which feeds the fiber sliver 2 to the opener device 116 according to its acceleration curve. The opener device 116 combs fibers 22 out of the forward end of the fiber sliver 2, i.e. out of the fiber tuft 21. The closer the fiber tuft 21 resembles the one which is fed to the opener device 116 during normal production, the greater the growth of the fiber stream produced by the opener device 116 which reaches the fiber collection surface 136 after a delay which depends on fiber material, on configuration and speed of the opener device 116, on the length of the fiber feeding channel 118, etc. This fiber stream reaching the fiber collection surface 136 is a determining factor for the piecing process.

As a function of the growth curve of the fiber flow which reaches the fiber collection surface 136, the yarn withdrawal is now controlled by means of the control device 40 which is connected to the control device 3, using the auxiliary drive roller 411, or the withdrawal acceleration and the increase of the fiber flow (in relation with the fiber collection surface 136) are determined so that their percentile increase until they reach production values is substantially synchronized.

But since the fiber flow is first of all prevented from reaching the fiber collection surface 136 and is fed to the fiber collection surface 136 only when the fiber flow has already reached a predetermined intensity, it is obvious that this synchronous run-up of fiber flow and yarn withdrawal can begin only a short time after switching over the fiber flow to the fiber collection surface.

Yarn withdrawal is therefore switched on by the control device 3 via control device 40 of the service unit 4 at the point in time $t_3$ when the fiber flow becomes effective in the spinning element 13—or shortly before or after this point in time $t_3$ and is accelerated according to the curve prescribed by the control device 3. This acceleration may be linear or my be controlled alongside any desired curve, depending on the run-up curve entered into the control device 3, whereby the run-up curve of the fiber flow is also defined according to this curve.

Yarn withdrawal is controlled by means of the auxiliary drive roller 411 bearing upon the bobbin 122. It is however also possible to control the yarn withdrawal curve by means of the draw-off roller 141 by controlling the bearing pressure of the draw-off roller 141 by means of the lift-off device 43.

Since the fiber tuft 21 is combed out more intensively during a long stoppage of the open-end spinning device 11 than during short stoppage, this is taken into account in controlling the fiber feeding device 110 and the yarn withdrawal which are therefore controlled as a function of the combed-out state of the fiber tuft 21. For this reason the combed-out state of the fiber tuft 21 is ascertained first. The yarn withdrawal is then controlled as a function of this state in such a manner that the yarn withdrawal speed is accelerated more slowly if the fiber tuft 21 has been affected to a greater degree (long stoppage time of the open-end spinning device 11) than when it has been affected to a lesser degree. In addition, or instead of this, yarn withdrawal can also start earlier (affected to a lesser degree) or later (affected to a greater degree) depending on the degree to which the fiber tuft 21 has been affected.

At the point in time, $t_4$, $T_{4a}$ or $T_{4b}$ the fiber flow has reached its full strength, with the above-described time lag behind fiber feeding device 110. After this point in time $t_4$, $T_{4a}$ or $t_{4b}$ the pressure roller 141 can thus again be brought to bear against the driven draw-off roller 140 by means of the lift-off device 43 and the withdrawal of the yarn 20 from the spinning device 11 can be effected by means of the draw-off device 14. The bobbin 122 can now be lowered on the winding roller 120, whereupon the auxiliary drive roller 411 is lifted off the bobbin 122.

If this is desired, the acceleration of the spinning element 13 can also be controlled as a function of the run-up of the fiber flow.

The described process and the device discussed above can be varied in many ways, e.g. by replacing individual characteristics by equivalents or by constituting other combinations thereof. Thus, it is not necessary, for example, to make the spinning element 13 as a spinning rotor, but it is absolutely possible to use other open-end spinning element, e.g. friction spinning rollers, etc. Nor it is necessary to provide a separate negative-pressure source 452 on the service unit 4, and the suction channel 450 can instead be connected in a known manner to a negative-pressure source on the machine to which the suction pipe 135 is also connected.

It is also possible to drive the drive roller 140 via a controlled slip coupling (not shown) from a drive shaft and to control yarn withdrawal in accordance with the effective slip.

Nor is it necessary for the acceleration curve for the fiber feeding device 110 to be calculated anew for each piecing process, e.g. because of the stoppage of the spinning device 11 after the occurrence of a yarn breakage (with the opener device 116 continuing to run). Instead, a suitable number of acceleration curves can be determined for the fiber feeding device 110 before the start of the spinning process and can be stored as program. When a yarn breakage then occurs, the state of the fiber tuft 21 is ascertained first of all in a suitable manner once the travelling service unit 4 has reached the affected spinning device 11. Depending on this state, the acceleration curve of the fiber feeding device 110 needed to attain the defined run-up curve of the fiber stream is then called up from the memory so that the fiber feeding device 110 runs up in accordance with the desired run-up curve of the fiber stream.

Similarly, such a program for the acceleration of the fiber feeding device 110 can also be selected from the programs stored in the program memory (part of the control device 3 or 40) as a function of given spinning parameters (fiber material and staple fiber length when batches are changed, speed of the opener device 116, etc.) if the state of the fiber tuft 21 is to remain the same at all times (an embodiment is described below).

It is furthermore possible to undertake such a program selection as a function of the state of the fiber tuft 21, as well as a function of the spinning parameters.

As an alternative to the time measuring device 33 in the open-end spinning machine 1, an adjusting knob 460 for the time control element 46 can be provided on the service unit in order to fix the time $t_2$, $t_{2a}$ or $t_{2b}$. This may be done as a function of different factors (fiber tuft state, fiber material, staple fiber length, width of the nip between delivery roller 111 and feeding trough 112 (or some other counter-element interacting with the delivery roller 111) or the operating range of the opener device 117, etc.). It is of course also possible to provide several adjusting knobs if desired (instead of the single adjusting knob 460) by means of which not only a given time $t_2$, $t_{2a}$ or $t_{2b}$ can be set, but by means of which different times or even the curve evolution of the fiber stream or the fiber feeding device 110 can be adjusted and/or spinning parameters can be entered. Depending on the design of this simple or more complex adjusting device and of the control device 3, missing values such as distortion between the acceleration of the fiber feeding device 110 and the run-up of the fiber stream are calculated and used as a basis for control.

Nor is it necessary to deduce the state of the fiber tuft 21 from the stoppage time of the fiber sliver 2 while possibly taking additional factors into account, but it may very well be ascertained by other means, e.g. optically, by measuring the air resistance, etc., if this were to be desirable. Before the beginning of the spinning process for example, and for stoppages of different length, the fibers reaching the fiber collection surface can be counted and measured for example, and from this inferences can be made on the combed-out state of the fiber tuft 21. The values thus obtained are entered into the control device 3 in order to set the times and the accelerations.

Alternatively, the fiber tuft 21 may extend through a light barrier, whereby the amount of light arriving in a photo diode provides indications on the damage done to the fiber tuft 21.

Figure 6:
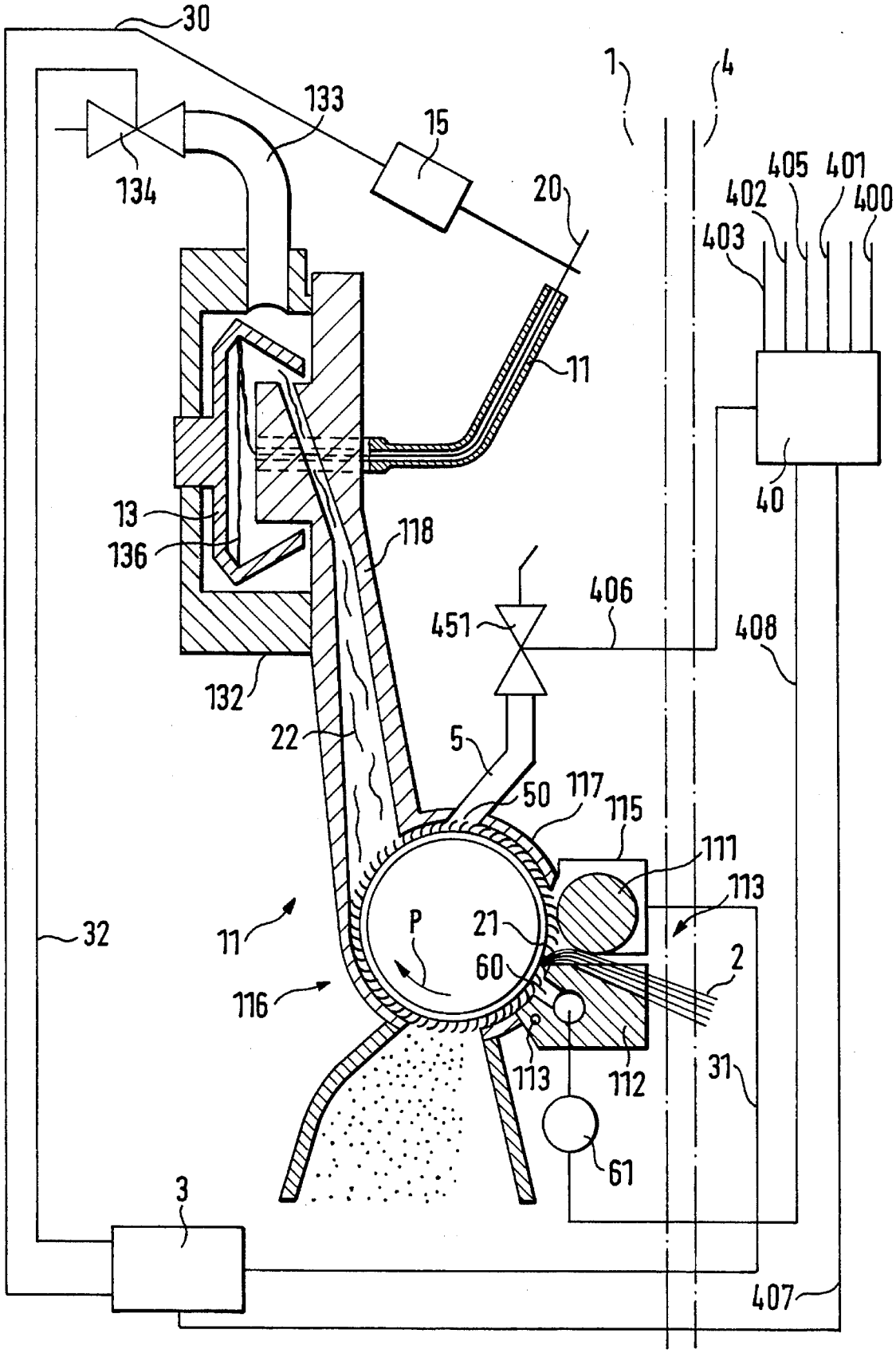
FIG. 6 schematically shows a side view of a spinning station modified from that shown in FIG. 1.

Another alternative for the ascertainment of the state of the fiber tuft is shown in FIG. 6. In this embodiment the fiber tuft 21 (FIG. 1) is examined by measuring negative pressure. This is because it has been shown that when a negative pressure is measured through the fiber tuft 21, the changes in negative pressure are substantially proportional to a change in the combed-out state of the fiber tuft 21. For this, negative pressure of a given intensity is produced on one side of the fiber tuft 21, i.e. in the housing 117, and the drop in negative pressure is measured on the other side of the fiber tuft 21.

FIG. 6 shows a device to carry out such a process. As the drawing shows, an opening 60 to which a manometer 61 is connected is provided in the feeding trough 112. The opening 60 can be covered by a sieve (not shown) or similar device in order to prevent the end of the winding device 12 from entering the opening 60. It has been shown however that such a sieve can be omitted as a rule, since the fiber tuft 21 leaves the opening 60 rapidly again due to the negative pressure in the opener device 116 if some of its fibers actually enter the opening.

If the fiber tuft 21 is unaffected or affected only slightly, the manometer 61 records a correspondingly high negative pressure. The manometer 61 is connected via circuit 408 to the control device 40 where the control of the fiber feeding device 110 with respect to start and acceleration is set in function of the negative pressure value and thus also in function of the current state of the fiber tuft 21.

If the fiber tuft 21 has been affected to a greater degree, the negative pressure decreases at the manometer 61. This slighter negative pressure is signalled to the control device 40 via circuit 408 so that the control device 40 may select the required program for the fiber feeding device 110 on basis of this signalled negative pressure.

If the fiber tuft 21 has been combed out much or very much, the negative pressure at the manometer 61 reaches its minimum value or approaches it, whereupon the control device 40 selects the corresponding program.

The measurement of the fiber tuft 21 can also be measured under production conditions, so that the change in negative pressure can be determined easily by comparison with the state during production.

The devices which detect or scan the fiber stream directly or indirectly are connected to the control device 3 and via the latter to the control device 40 of the service unit 4 during the execution of the piecing program and the preparatory tasks therefore. As mentioned earlier, such a scanning device can be designed in different manners, e.g. in the form of a manometer 61 to detect the state of the fiber tuft 21 which detects the fiber stream indirectly and without contact. Alternatively, an optical fiber stream measuring device is provided which detects the intensity of the fiber stream. This fiber stream measuring device is installed along the path of the fiber stream, between fiber feeding device 110 and fiber collection surface 136. When the fiber stream is measured directly, the fiber stream measuring device is best located in a manner not shown between the location where the fiber stream fed to the suction channel 5 leaves the normal path of the fiber stream fed to the fiber collection surface 136, i.e. at the inlet opening into the fiber feeding channel 118 and the fiber collection surface 136.

The device according to FIG. 6 makes it possible to ascertain the actual combed-out state of the fiber tuft 21 at every spinning station. This state is thus not extrapolated, so that the device with the manometer 61 also detects fluctuations from spinning station to spinning station and takes them into account in determining the piecing program.

If the fiber feeding device 110 is not equipped with a feeding trough, the opening 60 may also be provided at some other suitable location at the output of the fiber feeding device 110.

Another variation of the described process shall now be described below through FIG. 5. In order to have more time available for the back-feeding of the yarn end to the fiber collection surface 136 of the spinning element 13, the increase of the fiber flow is extended according to this process. This is achieved by flattening the acceleration curve B of the fiber feeding device 110. According to FIG. 5, the acceleration of the fiber feeding device 110 is even temporarily interrupted altogether and the fiber feeding device 110 is driven at constant speed during that time.

Figure 5:
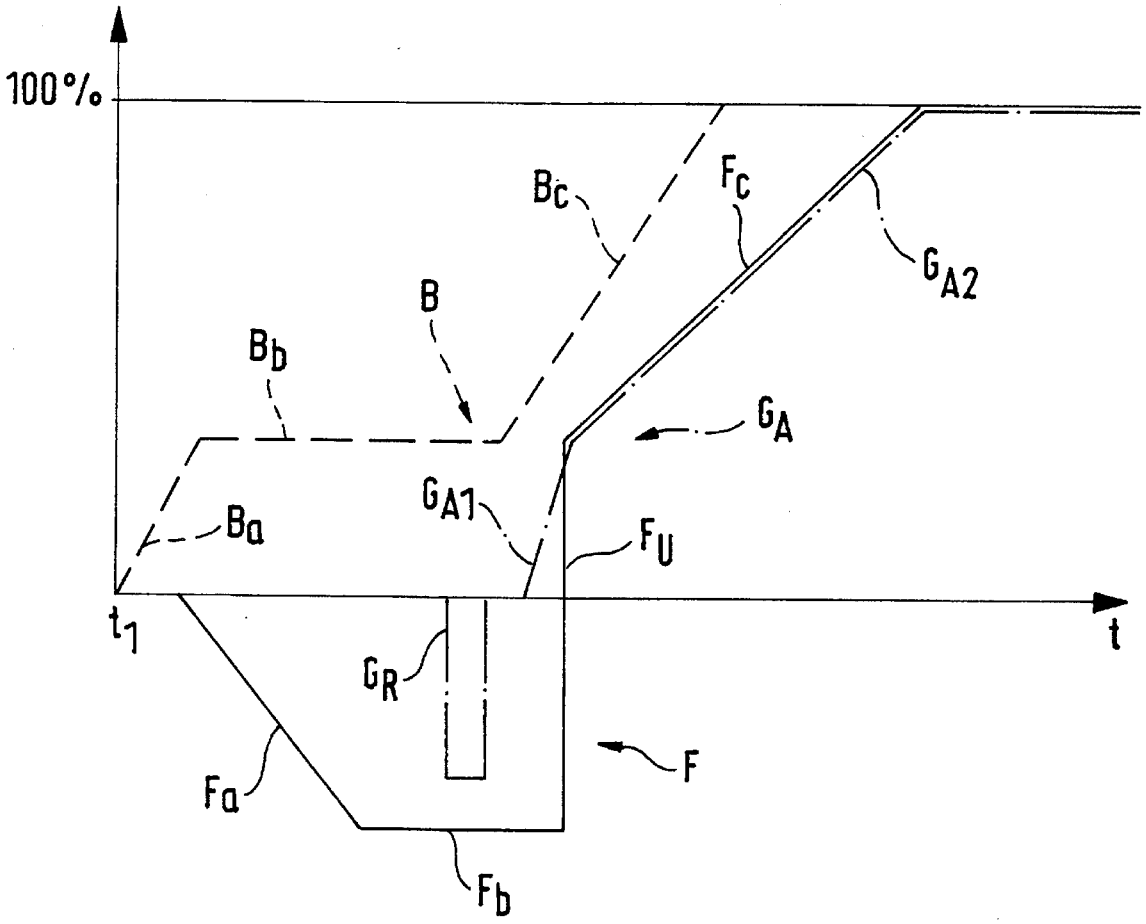
FIG. 5 schematically shows the synchronization between yarn withdrawal and fiber stream run-up.

In addition to the acceleration curve B which is made up of an initial acceleration phase $B_a$, an intermediate phase $B_b$ with constant speed (or alternatively with lesser acceleration) and a final acceleration phase $B_c$, FIG. 5 also shows a fiber flow F which accordingly, although offset in time, has a initial growing phase $F_a$, an intermediated phase $F_b$ with constant fiber flow and (following the switch-over phase $F_u$) a final growing phase $F_c$. In addition, the yarn back-feeding $G_R$ as well as the yarn withdrawal $G_A$ which goes through an initial acceleration phase GA1 and through a main acceleration phase $G_{A2}$, are shown. In the first phase $G_{A1}$ the yarn withdrawal is brought as rapidly as possible to the same value as the fiber flow F, wile the second phase $G_{A2}$ is synchronized with the increase of the fiber flow in the phase $F_c$. The fiber flow which is conveyed to removal via suction channel 450 is accordingly first brought rapidly to a value which is below production strength (100%). The fiber flow is then held at a constant level until the yarn 20 is fed back to the fiber collection surface. In coordination with this back-feeding of the yarn, the fiber stream is now switched over in order to feed it to the fiber collection surface 136. In this process the new conveying of fiber to the fiber collection surface 136 may occur before or after contact is made between the yarn end and the fiber collection surface 136, depending on the length of the yarn deposited on the fiber collection surface 136. Once the conveying of fiber to the fiber collection surface 136 has been initiated, the yarn 20 is again withdrawn at increasing speed from the fiber collection surface 136 while fibers 22 are constantly incorporated into it, whereby the fiber stream grows in accordance with the desired, previously defined run-up curve through appropriate control of the acceleration of the fiber feeding device 110. Yarn withdrawal is also accelerated, in coordination with the increase of the fiber stream.

The run-up of the fiber stream can be defined in different manners. Thus the fiber feeding device 110 can be switched on temporarily before piecing and for a sufficient period of time so as to be certain that enough is combed out of the fiber sliver 2 to put the fiber tuft 21 in the same state as during normal production. During this temporary combing-out of the fiber tuft 2 the combed-out fibers 22 are removed through the suction channel 5.

Following the temporary feeding of fibers to the opener device 116, the fiber feeding device 110 is again switched off for a defined period of time so that the fiber tuft 21 is always in the same state for each piecing process.

In such a case it is not necessary to control the run-up of the fiber feeding device 110 as a function of the time from the occurrence of a yarn breakage and the beginning of the piecing process. Instead, the fiber feeding device 110 is accelerated as a function of the always constant time between the end of the temporary feeding of fiber sliver and the actual beginning of the piecing operation.

It is also possible to determine the run-up of the fiber stream without fine-tuned coordination with yarn withdrawal. The latter can then be set in adaptation to the run-up of the fiber stream or possibly also in adaptation to the acceleration of the fiber feeding device 110, whereby the time discrepancy in the latter case between acceleration of the fiber feeding device 110 and the run-up of the fiber stream must be taken into consideration.

In an alternative process, the acceleration of the yarn withdrawal is monitored by means of control devices not shown here, and this can be carried out either by monitoring the control impulse for the auxiliary drive roller 411 or by scanning the surface speed of the auxiliary roller 411 or of a not-shown scanning roller lying on the bobbin surface and driven by bobbin 122. If it is found that the run-up of the fiber stream is not in synchronization with the acceleration of yarn withdrawal, a correction is made in the control of the drive 115 of the fiber feeding device 110 via control device 3 and/or 40.

Various modifications and variations can be made in the present invention without departing from the scope or spirit of the invention. For example, features illustrated or described as part of one embodiment may be used on another embodiment to yield a still further embodiment. The present invention is intended to cover such modifications and variations as come within the scope of the appended claims and their equivalents.

We claim:

1. A process for piecing on an open-end spinning machine wherein a fiber feeding device is switched on to produce a fiber stream which is initially deflected between the fiber feeding device and a fiber collection surface until the fiber stream has reached a predetermined strength less than full yarn production strength, and in which a yarn is subsequently back-fed to the fiber collection surface in coordination with deflecting the fiber stream to the fiber collection surface after the fiber stream has reached its less than full yarn production strength level, and in which the yarn is subsequently withdrawn from the fiber collection surface wile fibers are continuously incorporated into it, said process comprising:

defining a desired run-up curve for the fiber stream to be fed to the fiber collection surface for piecing;

defining an acceleration curve for the fiber feeding device which will produce the desired fiber stream run-up curve prior to switching on the fiber feeding device;

switching on the fiber feeding device and controlling acceleration of the fiber feeding device in accordance with the defined acceleration curve, the fiber stream being produced thereby being deflected from the fiber collection surface;

estimating from the fiber feeding device acceleration curve current actual fiber stream levels and deflecting the fiber stream to the fiber collection surface once the estimated fiber stream level has reached the predetermined strength level below full production strength; and back-feeding a yarn to the fiber collection surface in coordination with deflecting the fiber stream thereto.

2. The process as in claim 1, further comprising accounting for predetermined spinning parameters in said defining of the fiber feeding device acceleration curve.

3. The process as in claim 2, comprising detecting and accounting for the combed out state of the fiber tuft in defining the fiber feeding device acceleration curve.

4. The process as in claim 3, further comprising computing and storing different fiber feeding device acceleration curves for different combed out states of the fiber tuft, and selecting the defined acceleration curve from the stored acceleration curves depending on the combed out state of the detected fiber tuft.

5. The process as in claim 1, further comprising maintaining the fiber stream level relatively constant during backfeeding of the yarn to the fiber collection surface and bringing the fiber stream to full production strength along the fiber stream run-up curve as the yarn is subsequently withdrawn from the yarn collection surface.

6. The process as in claim 1, further comprising detecting and monitoring yarn withdrawal run-up and correcting if necessary acceleration of the fiber feeding device as a function of yarn withdrawal run-up if fiber stream run-up is not in synchronism with yarn withdrawal speed.

7. An open-end spinning machine having a fiber collection surface for incorporating individual fibers into a yarn end, a fiber feeding device for feeding a sliver tuft to an opener device for separating individual fibers therefrom to be conveyed in a fiber stream to said fiber collection surface, a yarn draw-off device for continuously drawing off yarn from said fiber collection surface, and a deflection device for deflecting said fiber stream from said fiber collection surface during piecing; said machine further comprising a drive arrangement operably associated with said fiber feeding device for accelerating said fiber feeding device during piecing; and a control device operably associated with said fiber feeding device drive arrangement, said deflection device, and said yarn draw-off device; said control device controlling switching on and acceleration of said fiber feeding device during piecing in accordance with a predetermined defined acceleration curve which has been defined as a function of a desired fiber stream run-up; said control device controlling said deflection device so as to deflect said fiber stream during piecing from said fiber collection surface as it controls acceleration of said fiber feeding device according to said acceleration curve until a predetermined fiber stream strength level has been reached which is lower than full production strength; said control device calculating fiber stream strength and subsequently deflecting said fiber stream to said fiber collection surface in coordination with backfeeding of a yarn to said fiber collection surface for piecing.

8. The machine as in claim 7, further comprising a scanning device configured to detect and monitor said fiber stream, said control device operably connected to said scanning device.

9. The machine as in claim 8, wherein said scanning device comprises a non-contact fiber stream measuring device disposed along the path of said fiber stream between said fiber feeding device and said fiber collection surface.

10. The machine as in claim 9, wherein said fiber stream measuring device is disposed between a fiber stream deflection point and said fiber collection surface.

11. The machine as in claim 10, wherein said scanning device comprises a device configured to detect the combed-out state of said fiber tuft at the point in time when piecing is initiated.

12. The machine as in claim 7, wherein said control device further comprises at least one manual adjusting device for adjusting said fiber stream run-up as a function of fiber feeding device acceleration.

13. The machine as in claim 12, wherein said adjusting device is configured for entering spinning parameters effecting piecing.

14. The machine as in claim 7, wherein said control device further comprises a memory of stored fiber feeding acceleration curves which have been defined for various combed out states of said fiber tuft presented to said opener device for piecing, said control device configured to select a particular acceleration curve from said memory which corresponds to the particular ascertained combed out state of said fiber tuft.

15. The machine as in claim 7, wherein said control device further comprises a memory of stored fiber feeding acceleration curves which have been defined for various sets of spinning parameters, said control device configured to select a particular acceleration curve from said memory which corresponds to the particular spinning parameters present for piecing.

16. The machine as in claim 7, wherein said control device further comprises a device for monitoring and controlling the speed of said yarn draw-off device as a function of acceleration of said fiber feeding device.

* * * * *

UNITED STATES PATENT AND TRADEMARK OFFICE

CERTIFICATE OF CORRECTION

PATENT NO : 5,456,073

DATED : OCTOBER 10, 1995

INVENTOR(S) : WOLFGANG THIERRON ET AL.

It is certified that error appears in the above-identified patent and that said Letters Patent is hereby corrected as shown below:

Claim 11, column 20, line 4, delete "10" and substitute therefor --8--.

Signed and Sealed this

Fourteenth Day of March, 2000

*Attest:*

*Attesting Officer*

Q. TODD DICKINSON

*Commissioner of Patents and Trademarks*